US005309749A

United States Patent [19]

Stodd

[11] Patent Number: 5,309,749

[45] Date of Patent: May 10, 1994

[54] METHOD AND APPARATUS FOR FORMING A CAN SHELL

[76] Inventor: Ralph P. Stodd, 6450 Poe Ave., Suite 213, Dayton, Ohio 45414

[21] Appl. No.: 55,274

[22] Filed: May 3, 1993

[51] Int. Cl.[5] ..... B21D 51/44

[52] U.S. Cl. ..... 72/336; 72/348; 413/6

[58] Field of Search ..... 72/329, 336, 348; 413/27, 31, 6, 4

[56] References Cited

U.S. PATENT DOCUMENTS 4,587,826 5/1986 Bulso, Jr. et al. ..... 72/348
4,637,961 1/1987 Bachmann et al. .
4,715,208 12/1987 Bulso, Jr. et al. .
5,042,284 8/1991 Stodd et al. .

*Primary Examiner*—Lowell A. Larson
*Attorney, Agent, or Firm*—Jacox & Meckstroth

[57] ABSTRACT

A sheet of metal is blanked by an annular blank die to form a disk, and a peripheral portion of the disk is gripped between the blank die and a lower pressure sleeve. The peripheral portion is shifted downwardly relative to a center portion of the disk to start the forming of a center panel within the disk between an annular nose portion of a die center and a high pressure panel punch having a small panel radius and a small clearance therebetween. The peripheral portion is also gripped between a lower die core ring and an upper pressure sleeve which cooperate to form a crown and a depending lip. The center panel is shifted downwardly by the die center against the pressure of the panel punch for forming an inwardly bowed chuckwall against the die core ring and to start a countersink by wrapping the metal around the nose portion of the die center. After the die center bottoms, reverses and is moving upwardly, a substantially cylindrical panel wall is formed within the nose portion of the die center by the panel punch, and the countersink is formed around the nose portion. The inwardly bowed chuckwall is subsequently formed straight during a seaming operation to produce a more cylindrical panel wall.

20 Claims, 3 Drawing Sheets

METHOD AND APPARATUS FOR FORMING A CAN SHELL

BACKGROUND OF THE INVENTION

In apparatus or tooling for forming end panels or shells for metal cans or plastic containers, for example, as disclosed in U.S. Pat. No. 5,042,284 which issued to the assignee of the present invention, it is desirable to construct the tooling so that the shells are produced from sheet metal or aluminum having a minimum gage or thickness. On the other hand, it is necessary for each shell to have sufficient strength for withstanding a predetermined pressure within the can without deforming or buckling. It is also desirable for the tooling to provide for high volume production of the shells on either a single or multiple action press and to complete the forming of each shell at a single station in order to avoid complicated reforming operations. Commonly, an end panel or shell includes a circular center panel which is connected by a panel radius and an annular panel wall to a U-shaped countersink portion having a countersink radius. The countersink portion is connected by a tapering or frusto-conical chuckwall portion to an upper crown portion which extends outwardly to a depending peripheral lip portion.

One of the common problems encountered in producing end panels or shells is the stretching and thinning of the sheet metal when forming a small panel radius and a small countersink radius. If there is stretching and thinning of the sheet metal in these areas, the strength of the shell rapidly decreases, with the result that the shells are unacceptable for use. The stretching and thinning of the sheet metal around the panel radius and countersink radius can result from tooling which draws the chuckwall and center panel from the sheet metal.

The center panel wall and the countersink have also been formed after drawing the chuckwall, for example, as disclosed in U.S. Pat. No. 4,715,208. In this patent, the center panel is moved upwardly with the die center and panel punch after the chuckwall is formed. However, this method does not provide for a uniform countersink radius or a small panel radius or a cylindrical panel wall of maximum length, each of which is important for producing a high strength shell with a sheet material of minimum thickness. Other forms of tooling and method for producing shells are disclosed in U.S. Pat. No. 4,637,961. In this patent, the chuckwall is formed at one tooling station and then the center panel, panel wall and countersink are formed at a second tooling station.

SUMMARY OF THE INVENTION

The present invention is directed to an improved method and apparatus for efficiently producing end panels or shells for cans and other containers and which is adapted for use on either a single or multiple action press for completely forming each shell at a single tooling station. The method and apparatus of the invention provide for significantly reducing the thickness or gage of the sheet metal used for producing the shells by avoiding stretching and thinning of the sheet metal around each radius, especially the panel radius and the countersink radius. In addition, the invention provides for precisely maintaining uniform dimensions of the shell and for obtaining a substantially cylindrical panel wall and a straight chuckwall in axial cross-section to obtain a shell with a maximum strength/weight ratio.

The above advantages and features are provided by a tooling assembly or system which first blanks a disk from a thin metal sheet and then grips and shifts a peripheral portion of the disk axially or downwardly relative to a center portion of the disk being pressed between a pressurized panel punch and an annular nose portion of a die center to define a center panel with a panel radius and a generally frusto-conical intermediate wall portion connecting the center panel to the peripheral portion. An inner part of the peripheral portion is gripped between a die core ring and an upper pressure sleeve for defining a crown portion, and an outer part of the peripheral portion is formed into a lip portion depending from the crown portion.

The center panel portion is shifted axially or downwardly relative to the die core ring and in a direction to reverse bend the intermediate wall portion and to wrap it around the nose portion and wipe it against tapered and cylindrical surfaces of the die core ring to form a reinforced chuckwall portion having an inwardly projecting annular bow or ridge. After the die center bottoms and begins moving upwardly, the pressurized panel punch presses the center panel into a cavity defined by the nose portion of the die center to form a substantially cylindrical panel wall and a countersink with a uniformally precision radius. This method also eliminates stretching and thinning of the metal around the panel radius and the countersink radius. Other features and advantages of the invention will be apparent from the following description, the accompanying drawings and the appended claims.

DESCRIPTION OF THE PREFERRED EMBODIMENT

Figure 13:
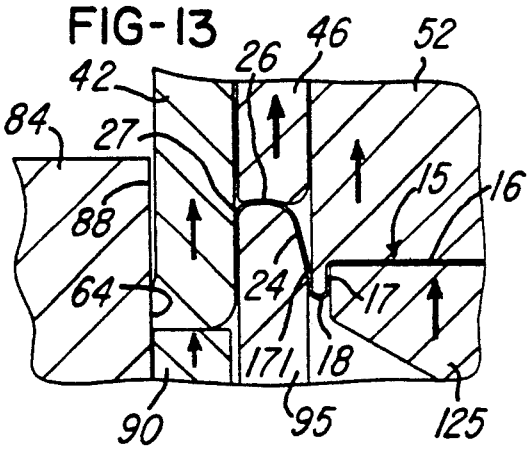

Referring to the drawings, FIG. 13 shows an enlarged shell 15 which is formed from aluminum having a thickness of about 0.0088 inch. The shell 15 includes a circular center panel portion 16 which is connected by a substantially cylindrical panel wall portion 17 to an annular countersink portion 18 having a U-shaped cross-sectional configuration. The countersink portion 18 has a uniform countersink radius 21 (FIG. 14) of about 0.020", and a panel radius 22 of about 0.013" connects the center panel portion 16 and the cylindrical panel wall portion 17. A tapered annular chuckwall portion 24 connects the countersink portion 18 to a crown portion 26, and a peripheral lip portion 27 depends from the crown portion 26.

Figure 1:
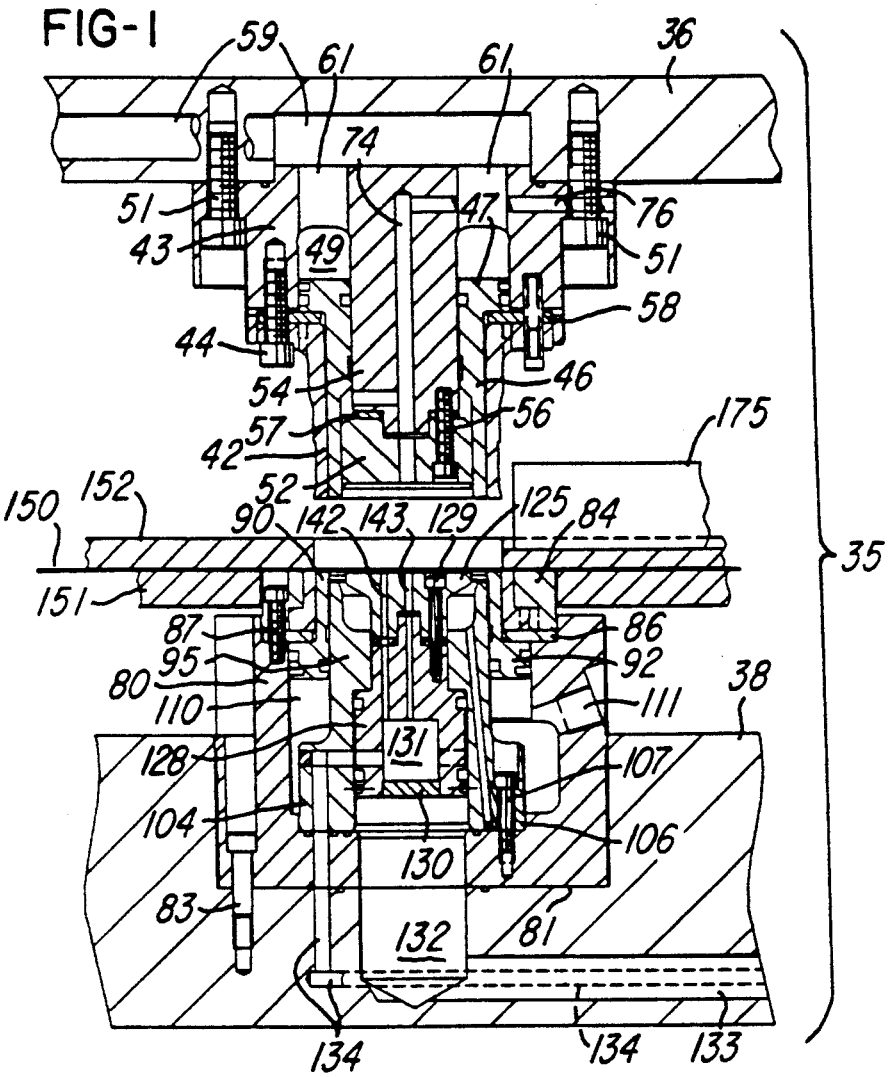
FIG. 1 is an axial section of a tooling assembly or station constructed and operated in accordance with the invention.

FIG. 1 illustrates a single station of a multiple station tooling assembly 35, for example, a 22 out tooling system. One shell 15 is produced at each station during each stroke of a conventional high speed single action or multiple action mechanical press. The tooling system or assembly 35 mounts on an upper die shoe 36 and a lower die shoe 38 which are supported by the press bed and/or bolster plates and the ram within the press. An annular blank and draw die 42 has an upper flange portion secured to a riser body 43 by a set of peripherally spaced screws 44, and the die 42 surrounds an upper pressure sleeve 46. The sleeve 46 has an upper piston portion 47 slidably supported within a chamber 49 defined within the riser body 43. A set of screws 51 secure the riser body to the upper die shoe 36. An inner die member or die center 52 is supported within the upper pressure sleeve 46 by a cylindrical die center riser 54 which is formed as part of the riser body 43. A set of screws 56 secure the die center 52 to the riser 54, and a flat annular spacer 57 is positioned between the die center 52 and riser 54. Another annular spacer 58 is located between the blank and draw die 42 and the riser body 43 and forms a bottom stop for the upper pressure sleeve piston 47. A passage 59 within the upper die shoe 36 directs low pressure air of about 20 to 40 p.s.i. to the chamber 49 through passages 61 within the riser body 43.

Figure 2:
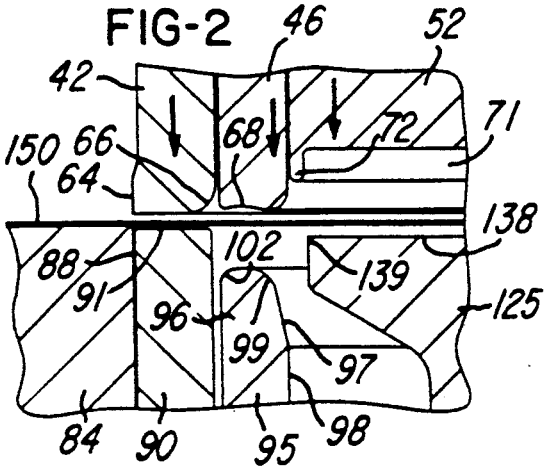
FIGS. 2–13 are enlarged fragmentary sections of the tooling assembly shown in FIG. I and illustrating the progressive steps for producing a shell in accordance with the invention.

As shown in FIG. 2, the blank and draw die 42 has a cylindrical lower cutting edge 64 and an inner curved forming surface 66. The lower end of the upper pressure sleeve 46 has a contoured annular forming surface 68, and the lower end of the die center 52 has a circular recess or cavity 71 defined by an annular projection or nose portion 72. The projection 72 has a curved bottom surface with a radius preferably between 0.015" and 0.020". As also shown in FIG. 1, a center axially extending vent passage 74 is formed within the center of the die center 52 and riser 54 and connects with a radial vent passage 76 within the riser body 43.

An annular die retainer 80 is mounted on the lower die shoe 38 within a circular counterbore 81 and is secured to the lower die shoe by circumferentially spaced screws 83. An annular cut edge die 84 with a hardened insert is secured with a spacer washer 86 to the retainer 80 by peripherally spaced screws 87 and has an inner cylindrical cutting edge 88 (FIG. 2) with substantially the same diameter as the cutting edge 64 on the blank and draw die 42. An annular lower pressure sleeve 90 includes a lower piston portion 92 (FIG. 1) supported for sliding movement within the retainer 80, and the sleeve 90 has a flat upper end surface 91 (FIG. 2) which opposes the bottom surface of the blank and draw die 42.

A die core ring 95 is positioned within the lower pressure sleeve 90 and has an upper end portion 96 (FIG. 2) with an inner frusto-conical or tapered surface 97 extending to a cylindrical surface 98, an inner rounded surface 99 and an outer rounded surface 102. The die core ring 95 also has a base portion 104 (FIG. 1) which is received within a counter bore or recess 106 formed within the retainer 80. The base portion 104 is secured to the die retainer 80 by a set of four circumferentially spaced screws 107. An annular chamber 110 is defined within the die retainer 80 around the die core ring 95 for receiving the piston portion 92 of the lower pressure sleeve 90, and low pressure air c)f about 40 p.s.i. is supplied to the chamber 110 through a passage 111 connected to an air supply line.

A circular panel punch 125 (FIG. 1) is positioned within the die core ring 95 and is secured to a panel punch piston 128 by a set of screws 129. The panel punch piston 128 is supported for axial movement within the die core ring 95, and the lower end of the piston 128 is closed by a plate 130 to define a chamber 131 within the piston. High pressure air, on the order of 400 p.s.i. , is supplied to a chamber 132 under the piston 128 through a laterally extending passage 133 within the lower die shoe 38. A low pressure air supply passage 134 also extends within the lower die shoe 38 and through the die retainer 80 and base portion 104 of the die core ring 95 to the chamber 131 within the piston 128 for the panel punch 125.

Referring to FIG. 2, the panel punch 125 has a circular flat upper surface 138 which extends to a peripheral surface 139 having a small panel radius of about 0.013" or less. The panel punch 125 al so has a set of three circumferentially spaced and axially extending air passages 142 (FIG. 1) and a center air passage 143 which extend into the chamber 131 within the panel punch piston 128.

Figure 3:
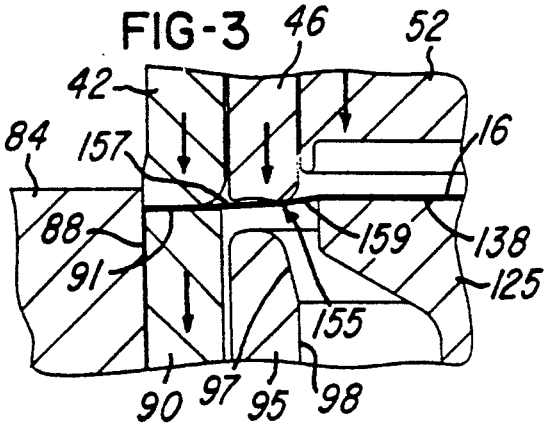
Figure 4:
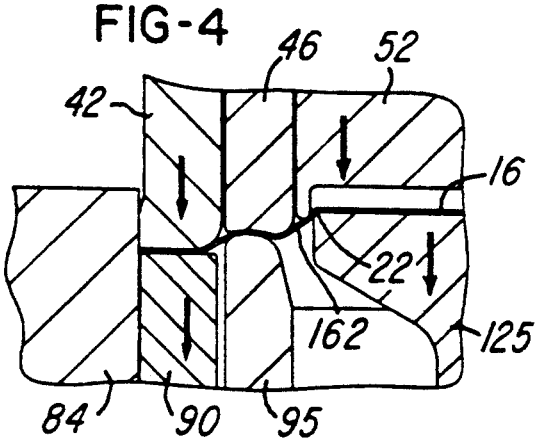
Figure 5:
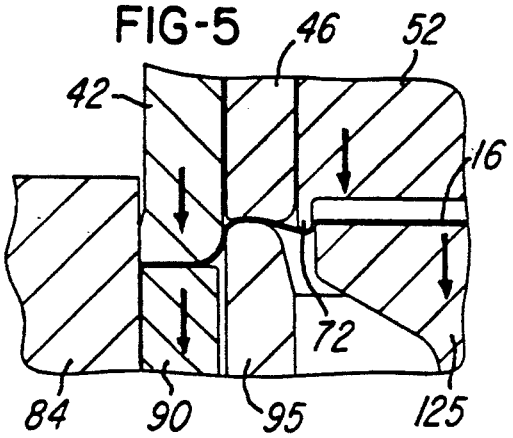
Figure 6:
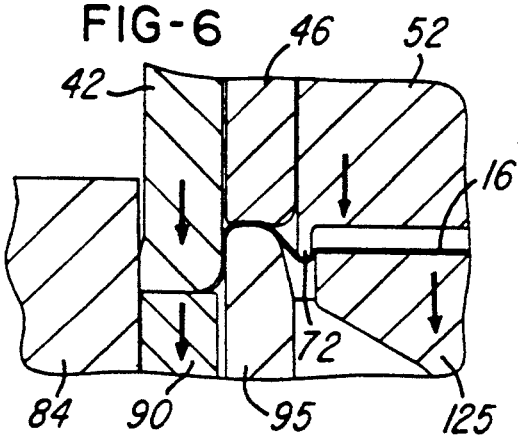
Figure 7:
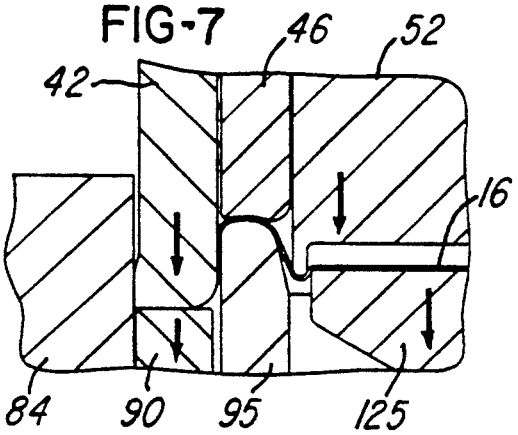
Figure 8:
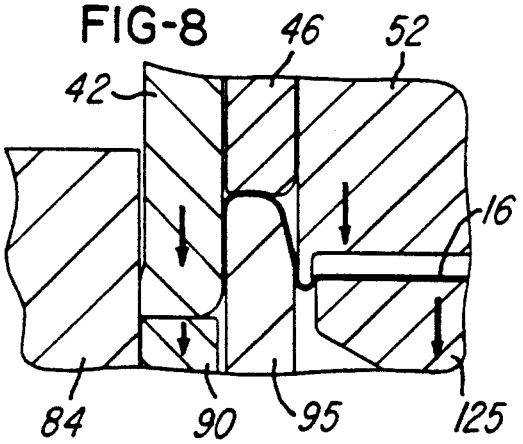

The operation of the tooling system or assembly 35 for successively forming shells 15, is now described in connection with FIGS. 2–13. As shown in FIGS. 1 and 2, a continuous strip or sheet 150 of aluminum having a thickness of about 0.0088", is fed on a stock plate 151 across the cut edge die 84 and below a stripper plate 152. When the upper die shoe 36 moves downwardly, the mating shearing edges 64 and 88 (FIG. 2) blank out a circular disk 155 (FIG. 3). As the blank and draw die 42 continues to move downwardly (FIG. 3), a peripheral edge portion 157 of the disk 155 is confined between the blank die 42 and the upper surface 91 end of the lower pressure sleeve 90. As the upper pressure sleeve 46 moves downwardly with the blank and draw die 42 (FIG. 2), an annular intermediate portion 159 of the disk 155 begins to wrap around the peripheral edge surface 139 of the panel punch 125. The air pressure below the lower pressure sleeve 90 is selected to produce a predetermined clamping or gripping pressure against the peripheral portion 157 of the disk 155 and to allow the peripheral portion 157 to slide radially inwardly between the blank die 42 and lower pressure sleeve 90, as shown in FIGS. 3–5.

As the blank and draw die 42 and upper pressure sleeve 46 continue to move downwardly (FIG. 4), an inner part of the intermediate portion 159 of the disk 155 forms into a frusto-conical portion 162, and the portion 162 starts to wrap around the slightly rounded edge 139 of the panel punch 125 so that the center panel 16 is defined on top of the panel punch. As a result of a small clearance of less than 0.005" and about 0.001"–0.002" over metal thickness between the outer cylindrical surface of the panel punch 125 and the inner cylindrical surface of the nose portion 72 of the die center 52, the panel 16 does not continue further into the cavity 71.

As the die center 52 and panel punch move further downwardly with the blank and draw die 42 (FIGS. 5–9), the material wraps around the downwardly projecting nose portion 72 of the die center 52 and slides down the tapered wall surface 97 of the die core ring 95 and slides between the upper pressure sleeve 46 and the die core ring 95 and between the blank and draw die 42 and die core ring 95 to form the crown 26, lip 27 and chuckwall 24 of the shell 15.

Figure 9:
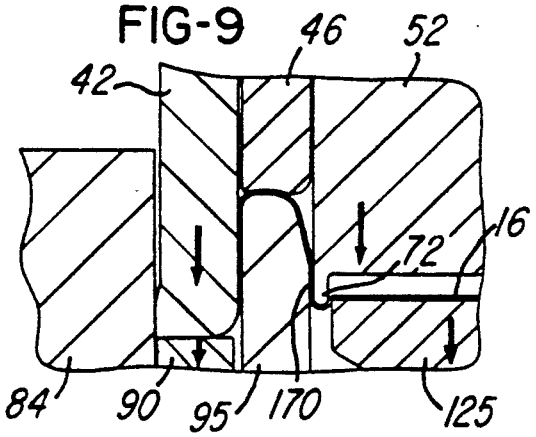
Figure 10:
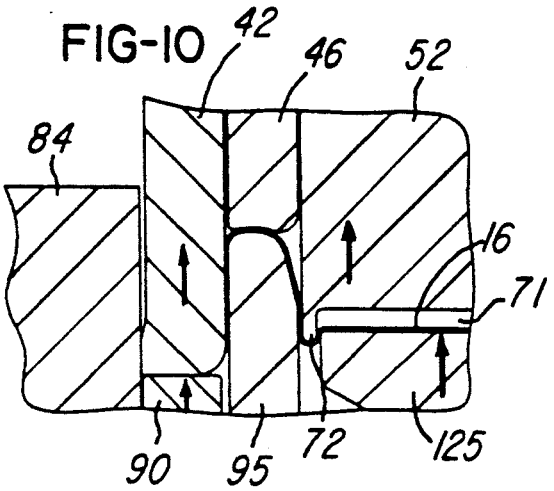
Figure 11:
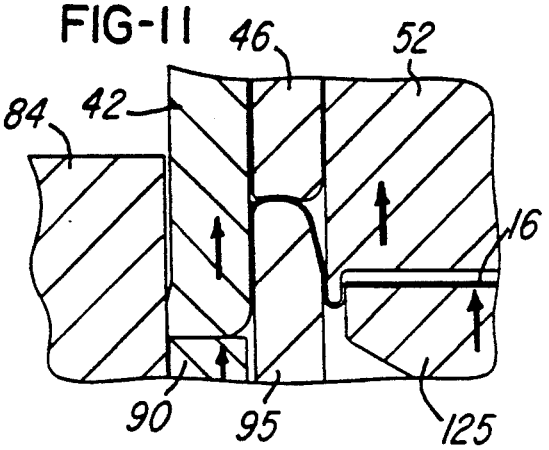
Figure 12:
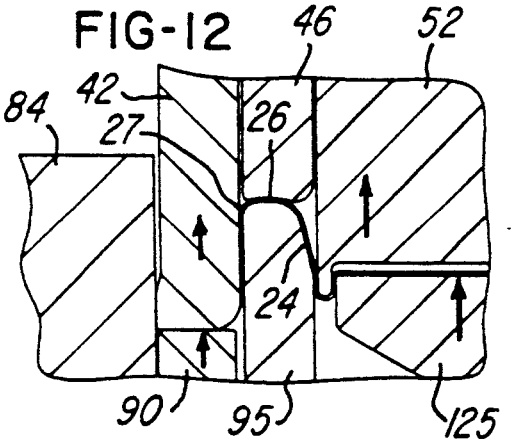

As also shown in FIG. 9, as a result of the further downward movement of the die center 52 and the small clearance over metal of less than 0.005" and about 0.001"–0.002" between the outer cylindrical surface of the nose portion 72 and the inner cylindrical surface 98 of the die core ring 95, the chuckwall 24 continues further downwardly to form a cylindrical portion 170 which cooperates with the tapered portion 24 to form an annular bow or ridge 171 within the chuckwall when the die center 52 and panel punch 125 bottom at their closed positions. Referring to FIGS. 10–13, as the upper die shoe 36 and the die center 52 reverse and move upwardly, the metal forming the cylindrical portion 170 rolls around the nose portion 72 of the die center 52, and the upward pressure on the panel punch 125 moves the center panel upwardly within the cavity 71 until the center panel 16 engages the bottom surface of the die center 52. As the metal rolls around the nose portion 72 of the die center 52, the substantially vertical or cylindrical panel wall 17 is formed between the outer surface of the panel punch 125 and the inner surface of the die center nose portion 72. As also apparent in FIG. 13, after the panel wall 17 and countersink 18 are formed, the chuckwall 24 still includes the inwardly projecting annular bow or ridge 171.

After a shell 15 is completed (FIG. 13) and the upper die shoe 36 is moving upwardly, the shell 15 is retained by friction within the blank and draw die 42. The shell 15 is released from the die center 52 by downward movement of the upper pressure sleeve 46 and venting through the passages 74 and 76. While the upper die shoe 36 is moving upwardly, pressurized jets of air are directed upwardly from the air passages 142 and 143 so that the shell 15 is held against the bottom surface 68 of the upper pressure sleeve 46. When the blank and draw die 42 arrive at a predetermined elevation and the panel punch piston 128 stops upward movement within the die core ring 125, the upper pressure sleeve 46 and shell 15 are shifted downwardly to the starting position, and the shell 15 is released by the vent passage 74 so that the shell 15 is free for lateral ejection or discharge into a guide chute 175 (FIG. 1) by a jet of air from a nozzle (not shown) connected to a pressurized air supply.

Figure 14:
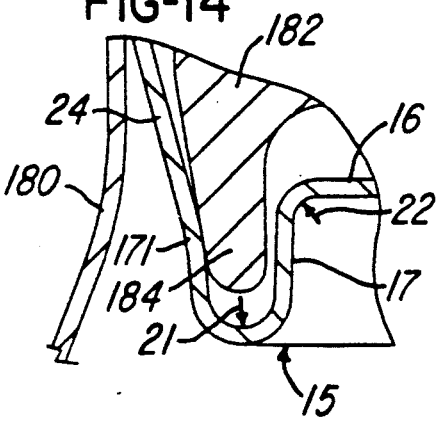
FIGS. 14 and 15 are enlarged fragmentary sections of the final shell shown in FIG. 13 and illustrating a subsequent step of deforming the shell while it is being seamed to a can.
Figure 15:
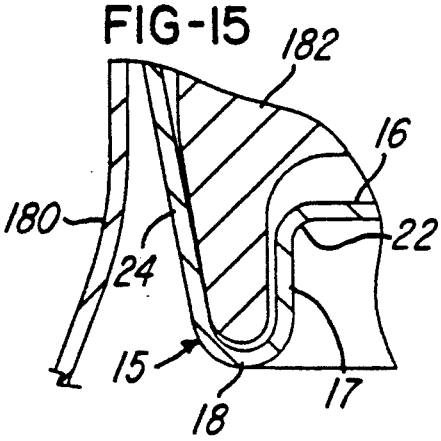

Referring to FIGS. 14 and 15, when the shell 15 is being attached to the neck or upper end portion 180 of a one-piece aluminum can by a seamer machine, a seamer chuck 182 with a depending annular nose portion 184 is brought into engagement with the shell 15 so that the seamer chuck portion 184 engages the inwardly projecting bow or ridge portion 171 of the chuckwall 24. The chuck portion 184 presses radially outwardly on the ridge portion 171 so that the chuckwall 24 becomes substantially straight in axial cross-section (FIG. 15), and the panel wall 17 moves to a substantially vertical or cylindrical configuration (FIG. 15) to obtain the maximum strength/weight ratio for the shell 15.

From the drawings and the above description, it is apparent that the method and apparatus of the present invention provide desirable features and advantages. As one advantage, the tooling assembly of the invention is adapted for use on a single action press with each shell being completely formed at a single tooling station without any significant thinning of the sheet material. The method and apparatus also provide for producing the strongest shell from the thinnest gauge material for obtaining more economical production of the shells. That is, the method permits a significant reduction in the sheet metal thickness while increasing the strength of the shell to withstand substantial pressure within the container without buckling or deforming the shell.

More specifically, the panel radius 22 and countersink radius 21 may be minimized by rolling of the material around the nose portion 72 and between the nose portion and the closely spaced panel punch while the die center 52 and panel punch are moving upwardly. The capability to produce these minimum radiuses provides for increasing the axial length of the cylindrical panel wall 17 and thereby increases the strength of the shell 15 against buckling. Also, the formation of the panel wall 17 and the countersink 18 in this manner around the nose portion 72 provides for a precision and uniform countersink radius and avoids stretching and thinning of the thin sheet metal around the panel radius and countersink radius so that a thinner gage sheet metal may be used.

As also mentioned above, the small clearance over metal thickness between the nose portion 72 and the inner cylindrical surface 98 of the die core ring 95 provides for producing the inward bow or ridge 171 within the chuckwall 24. This reinforces the chuckwall and permits shifting the panel wall 17 to a vertical or cylindrical configuration by the subsequent operation during seaming, as shown in FIGS. 14 and 15.

While the method and form of apparatus herein described constitute a preferred embodiment of the invention, it is to be understood that the invention is not limited to the precise method and form of apparatus described, and that changes may be made therein without departing from the scope and spirit of the invention as defined in the appended claims.

The invention having thus been described, the following is claimed:

1. A method of forming a can end wall or shell from a flat metal sheet, the shell including a center panel having a peripheral panel radius and connected by an annular panel wall to an annular countersink having a countersink radius and with the countersink connected to an annular crown by a tapered annular chuckwall, the method comprising the steps of blanking a disk from the sheet, gripping a peripheral portion of the disk, moving the peripheral portion axially in one direction relative to a center portion of the disk, pressing the center portion of the disk with a panel punch against an annular nose portion defining a cavity within a die center to define the center panel and at least part of the panel radius between the nose portion and the panel punch, moving the center panel in the same direction with the die center and panel punch to wrap the center portion of the disk around the nose portion and to form the chuckwall against an annular die core ring surrounding the panel punch, and pressing the center panel in the opposite direction and into the cavity with the panel punch while moving the die center in the opposite direction to form the panel wall and to form the countersink around the nose portion of the die center.

2. A method as defined in claim 1 wherein the crown and chuckwall are formed before the center panel is pressed into the cavity within the die center and the countersink is formed around the nose portion of the die center.

3. A method as defined in claim 1 wherein the panel wall is formed substantially cylindrical between the annular nose portion of the die center and the panel punch within the cavity.

4. A method as defined in claim 1 and including the steps of forming the annular chuckwall with an annular ridge portion bowed inwardly slightly towards the panel wall, and deforming the ridge portion to a substantially straight configuration in axial cross-section for moving the panel wall to a substantially cylindrical configuration.

5. A method as defined in claim 1 and including the steps of forming the nose portion of the die center and the panel punch to define a radial clearance therebetween of less than 0.005 inch over the thickness of the metal sheet.

6. A method as defined in claim 1 and including the step of forming the nose portion of the die center and the die core ring to define a radial clearance therebetween of less than 0.005 inch over the thickness of the metal sheet.

7. A method as defined in claim 1 and including the steps of forming the die core ring with an inner cylindrical surface, and forming the nose portion of the die center with an outer cylindrical surface which moves into the inner cylindrical surface and defines therebetween a radial clearance of less than 0.005 inch over the thickness of the metal sheet.

8. A method as defined in claim 1 and including the steps of forming the nose portion of the die center with a substantially cylindrical inner surface, and forming the panel punch with an outer surface which moves into the inner surface and defines therebetween a radial clearance of less than 0.005 inch over the thickness of the metal sheet.

9. A method of forming a can end wall or shell from a flat metal sheet, the shell including a center panel having a peripheral panel radius and connected by an annular panel wall to an annular countersink having a countersink radius and with the countersink connected to an annular crown by a tapered annular chuckwall, the method comprising the steps of blanking a disk from the sheet, gripping a peripheral portion of the disk, moving the peripheral portion axially in one direction relative to a center portion of the disk, pressing the center portion of the disk with a panel punch against an annular nose portion defining a cavity within a die center to define the center panel and at least part of the panel radius between the nose portion and the panel punch, moving the center panel in the same direction with the die center and panel punch to wrap the center portion of the disk around the nose portion and to form the chuckwall against an annular die core ring surrounding the panel punch, extending the nose portion into the die core ring to form a generally cylindrical extension of the chuckwall, and pressing the center panel in the opposite direction and into the cavity with the panel punch while moving the die center in the opposite direction to form a substantially cylindrical panel wall and to form the extension of the chuckwall around the nose portion of the die center to form the countersink.

10. A method as defined in claim 9 wherein the crown and chuckwall are formed before the center panel is pressed into the cavity within the die center and the extension of the chuckwall is formed around the nose portion of the die center.

11. A method as defined in claim 9 and including the steps of forming the annular chuckwall with an annular ridge portion bowed inwardly slightly towards the panel wall, and subsequently deforming the ridge portion to form a chuckwall having a substantially straight configuration in axial cross-section and for moving the panel wall to a substantially cylindrical configuration.

12. A method as defined in claim 9 and including the steps of forming the nose portion of the die center and the panel punch to define a radial clearance therebetween of about 0.002 inch over the thickness of the metal sheet.

13. A method as defined in claim 9 and including the step of forming the nose portion of the die center and the die core ring to define a radial clearance therebetween of about .002 inch over the thickness of the metal sheet.

14. A method as defined in claim 9 and including the steps of forming the die core ring with an inner cylindrical surface, and forming the nose portion of the die center with an outer cylindrical surface which moves into the inner cylindrical surface to form the extension of the chuckwall and defines therebetween a radial clearance of about 0.002 inch over the thickness of the metal sheet.

15. A method as defined in claim 9 and including the steps of forming the nose portion of the die center with a substantially cylindrical inner surface, and forming the panel punch with a substantially cylindrical outer surface which moves into the inner surface and defines therebetween a radial clearance of about 0.002 inch over the thickness of the metal sheet.

16. Apparatus adapted for forming a can end wall or shell from a flat metal sheet at a single station of a press, the shell including a center panel having a peripheral panel radius and connected by an annular panel wall to an annular countersink having a countersink radius and with the countersink connected to an annular crown by a tapered annular chuckwall, said apparatus comprising an annular blank die and an opposing annular first pressure sleeve supported for blanking a disk from the sheet, an annular second pressure sleeve within said blank die and an opposing annular die core ring within said first pressure sleeve, a die center within said second pressure sleeve and an opposing panel punch disposed within said die core ring, said die center having a peripherally extending annular nose portion projecting axially to define a cavity, said panel punch having an end surface opposing said cavity and a peripheral surface, means for moving said blank die, said first pressure sleeve and second pressure sleeve axially relative to said panel punch for moving a peripheral portion of the disk axially in one direction to define the center panel and at least part of said panel radius between said nose portion and said panel punch and to form an intermediate wall portion connecting the panel to the peripheral portion, means for gripping the peripheral portion of the disk between said second pressure sleeve and said die core ring, means for moving the center panel in the same direction with said die center and said panel punch to wrap the intermediate portion of the disk around said nose portion and to form the chuckwall against said annular die core ring, and means for moving said panel punch in the opposite direction and into said cavity while said die center is moving in the opposite direction for pressing the center panel into said cavity to form the panel wall and to form the countersink around said nose portion of said die center.

17. Apparatus as defined in claim 16 wherein said nose portion of said die center and said panel punch define a radial clearance therebetween of less than 0.005 inch over the thickness of the metal sheet.

18. Apparatus as defined in claim 16 wherein said nose portion of said die center and said die core ring define a radial clearance therebetween of less than 0.005 inch over the thickness of the metal sheet.

19. Apparatus as defined in claim 16 wherein said die core ring has an inner cylindrical surface, and said nose portion of said die center has an outer cylindrical surface which moves into said inner cylindrical surface and defines therebetween a radial clearance of less than 0.005 inch over the thickness of the metal sheet.

20. Apparatus as defined in claim 16 wherein said nose portion of said die center has a substantially cylindrical inner surface, and said panel punch has an outer surface which moves into said inner surface and defines therebetween a radial clearance of less than 0.005 inch over the thickness of the metal sheet.

* * * * *